US006202750B1

(12) United States Patent
Ohanesian

(10) Patent No.: US 6,202,750 B1
(45) Date of Patent: Mar. 20, 2001

(54) DUAL CYLINDER WATER WELL FILTER AND METHOD OF USING THE SAME

(75) Inventor: Harout Ohanesian, 9 Tattersail La., Laguna Niguel, CA (US) 92677

(73) Assignee: Harout Ohanesian, Laguna Niguel, CA (US)

( * ) Notice: Subject to any disclaimer, the term of this patent is extended or adjusted under 35 U.S.C. 154(b) by 0 days.

(21) Appl. No.: 09/346,494

(22) Filed: Jun. 30, 1999

(51) Int. Cl.[7] ..... E03B 3/18; E21B 43/02
(52) U.S. Cl. ..... 166/236; 166/228
(58) Field of Search ..... 166/227, 228, 166/234, 235, 236

(56) References Cited

U.S. PATENT DOCUMENTS

| | | | | |
|---|---|---|---|---|
| 3,357,564 | * | 12/1967 | Medford, Jr. et al. | 210/266 |
| 4,014,387 | * | 3/1977 | Fink | 166/369 |
| 4,624,319 | * | 11/1986 | Van Der Borght | 166/369 |
| 4,649,996 | * | 3/1987 | Kojicic | 166/228 |
| 5,642,781 | * | 7/1997 | Richard | 166/231 |
| 5,855,242 | * | 1/1999 | Johnson | 166/236 |

* cited by examiner

*Primary Examiner*—David Bagnell
*Assistant Examiner*—Jennifer R. Dougherty
(74) *Attorney, Agent, or Firm*—Myers, Dawes & Andras LLP; Vic Lin; Joseph C. Andras

(57) ABSTRACT

The invention is a water well filter. An outer pipe is concentric with an inner pipe. Each pipe has a plurality of water passage apertures. The outer pipe is shorter than the inner pipe, but long enough to cover the apertures of the inner pipe. The outer pipe is attached to non-apertured portions of the inner pipe by sealing rings disposed at an upper and lower end of the upper pipe so as to form a gap between the pipes. The sealing rings are welded onto the inner and outer pipes. A granulated filter material fills the gap. The filter granules may be bonded to each other as well as to the surfaces of the pipes. A nylon mesh cover is disposed on the outer surface of the inner pipe to prevent filter granules from entering through the inner pipe apertures. The inner pipe has an internally threaded portion at one end and an externally threaded portion at the other end so as to allow multiple inner pipes, and thus multiple water well filters, to be attached end to end. The outer pipe, inner pipe, sealing rings, and granulated filter material all comprise unplasticized polyvinyl chloride. The invention also comprises a method for filtering out particulate matter from water in a well.

26 Claims, 6 Drawing Sheets

DUAL CYLINDER WATER WELL FILTER AND METHOD OF USING THE SAME

BACKGROUND OF THE INVENTION

1. Field of the Invention

The invention relates to the field of water well filters.

2. Description of Prior Art

In certain geographical areas, aquifer layers containing water exist beneath the surface layers of the earth. Wells may be provided to access the aquifer layers and a filtering device may be inserted into the well to extract and filter the water in the aquifer layers. Water from the aquifer layers naturally contain a substantial amount of particulate matter. Such water when satisfactorily filtered and extracted can be used for a number of beneficial purposes.

Screened metal pipes have been used to filter water in wells. Metal pipes, however, tend to be heavy which presents a problem for workers who have to manually insert and lower the pipes into the wells. Metal pipes also deteriorate quickly in the water well environment, which can lead to weakness in the vertical pipe column. As a result of prolonged contact with water, detritus may develop and cause the metal to rust, allowing bacteria to develop and contaminate the water.

Screened plastic pipes have also been used to filter water in wells. However, both plastic and metal filters consist of pipes attached end to end to form a single conduit having only a single wall between the exterior and the interior of the conduit. Thus, the single-walled filters tend to allow particulate matter in the water which are smaller than the size of the screen to pass through into the water distribution system inside the filter.

Significant water flow into the pipe is important since the water will have to be moved up along the pipe. Typically, this is accomplished with a pump disposed inside and at the bottom of the pipe. If insufficient water flows into the pipe, the pump will be unable to move the water up along the pipe to its intended destination. To increase water flow, more screens can be formed into the pipes. However, creating more screens will weaken the pipe and decrease its longevity.

Therefore, what is needed is a water well filter that:

1) is lighter so that workers can more easily use the filter;
2) will last longer than current filters;
3) will allow significant water flow throughput without compromising filter strength; and
4) will filter fine particulate matter in the water.

BRIEF SUMMARY OF THE INVENTION

The invention is a water well filter. An outer pipe is concentric with an inner pipe. The outer pipe has an outer plurality of water passage apertures, or slots, while the inner pipe has an inner plurality of water passage apertures, or slots. Both the inner and outer plurality of water passage apertures extend from an outer surface to an inner surface of their respective pipe. The outer pipe has a length that is shorter than that of the inner pipe, but long enough to cover the entire inner plurality of water passage apertures. The inner pipe has an internally threaded portion at either the upper or lower end, and an externally threaded portion at an opposite end. Therefore, the upper end of the inner pipe may be attached to the lower end of another inner pipe of another water well filter, or at least the lower end of another pipe. The outer pipe is attached to nonapertured portions of the inner pipe by upper and lower sealing rings disposed at upper and lower ends of the outer pipe, respectively. The outer pipe is attached to the inner pipe so as to form an annular gap between the outer surface of the inner pipe and the inner surface of the outer pipe.

A permeable, granulated filter material fills the gap. Thus, the sealing rings serve to close the gap and seal the granulated filter material. The granulated filter material may include a bonding mechanism so that the filter granules are bonded together. The filter granules may also be bonded to the outer surface of the inner pipe and the inner surface of the outer pipe. A permeable cover comprising nylon mesh is disposed on the outer surface of the inner pipe. The permeable cover has openings with an opening cross-dimension less than the granule cross-dimension of the filter granules so that the filter granules cannot reach the inner plurality of water passage apertures.

The outer pipe, inner pipe, sealing rings and granulated filter material all comprise unplasticized polyvinyl chloride ("UPVC"). Therefore, the sealing rings may be welded onto the outer and inner pipes.

The invention also comprises a method for filtering out particulate matter from water in a well, the method comprising: passing the water through a first plurality of apertures in a first barrier; blocking an initial portion of the particulate matter with the first barrier; passing the water through filter granules; blocking a first intermediate portion of the particulate matter with filter granules; passing the water through a second plurality of apertures in a second barrier; and blocking a final portion of the particulate matter with the second barrier. The method may further comprise: disposing a permeable cover with a plurality of openings onto the second barrier; passing the water through the plurality of openings in the cover; and blocking a second intermediate portion of the particulate matter with the cover.

The invention, now having been briefly summarized, may be better visualized by turning to the following drawings wherein like elements are referenced by like numerals.

The invention and its various embodiments can now be better understood by turning to the following detailed description wherein an illustrated embodiment is described. It is to be expressly understood that the illustrated embodiment is set forth as an example and not by way of a limitation to the invention as defined in the following claims.

DETAILED DESCRIPTION OF THE PREFERRED EMBODIMENTS

Figure 1:
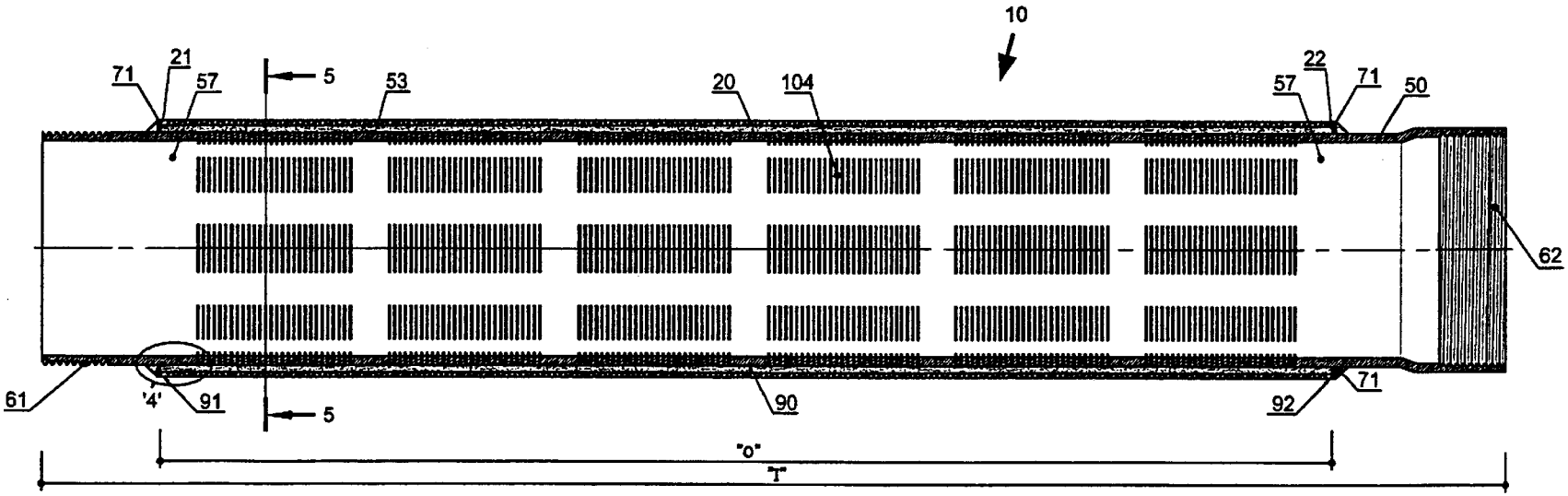
FIG. 1 is a longitudinal sectional view of the invention.

FIG. 1 is a longitudinal cross-section view of the invention 10 comprising a water well filter. The invention 10 comprises an outer cylinder 20 surrounding an inner cylinder 50. The cylinders are preferably in the form of circular pipes made of a polymer material. In the preferred embodiment, the polymer material comprises unplasticized polyvinyl chloride ("UPVC").

Figure 2:
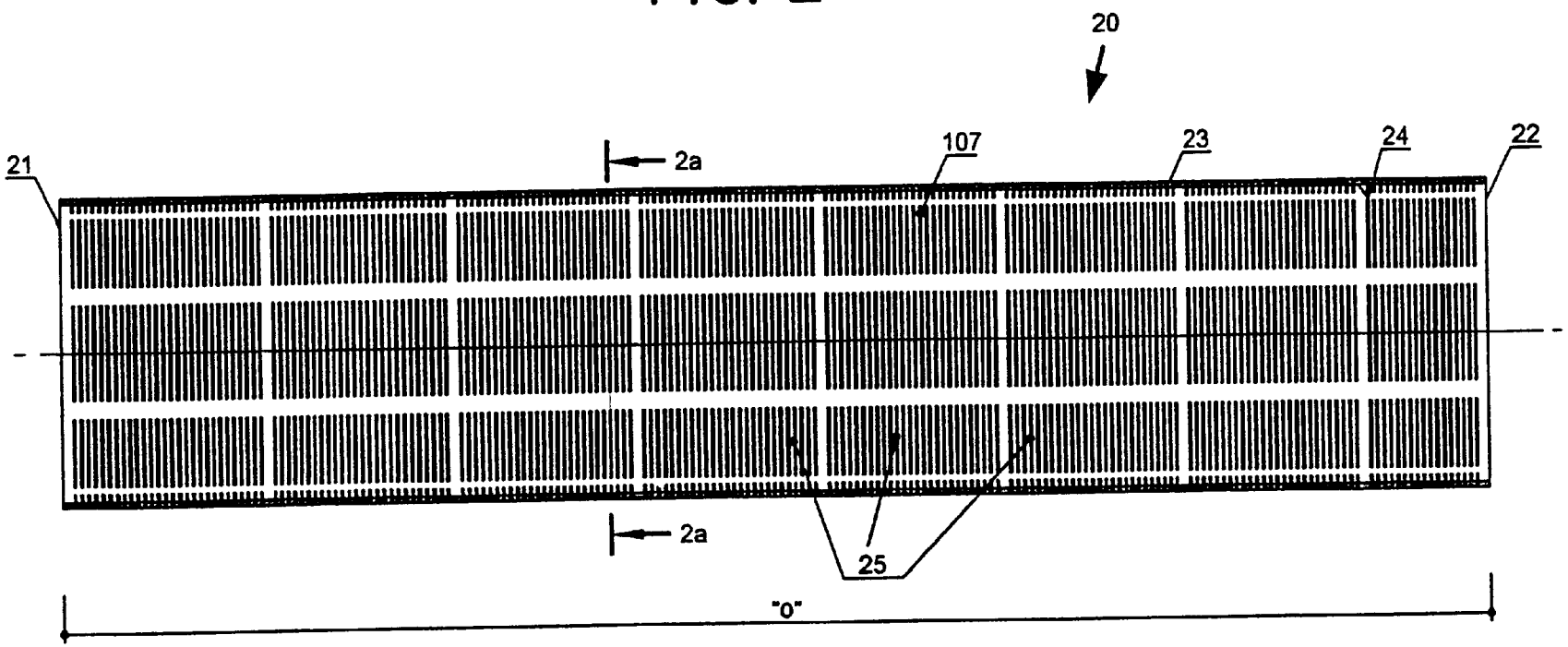
FIG. 2 is a longitudinal cross-section view of the outer cylinder.
Figure 2A:
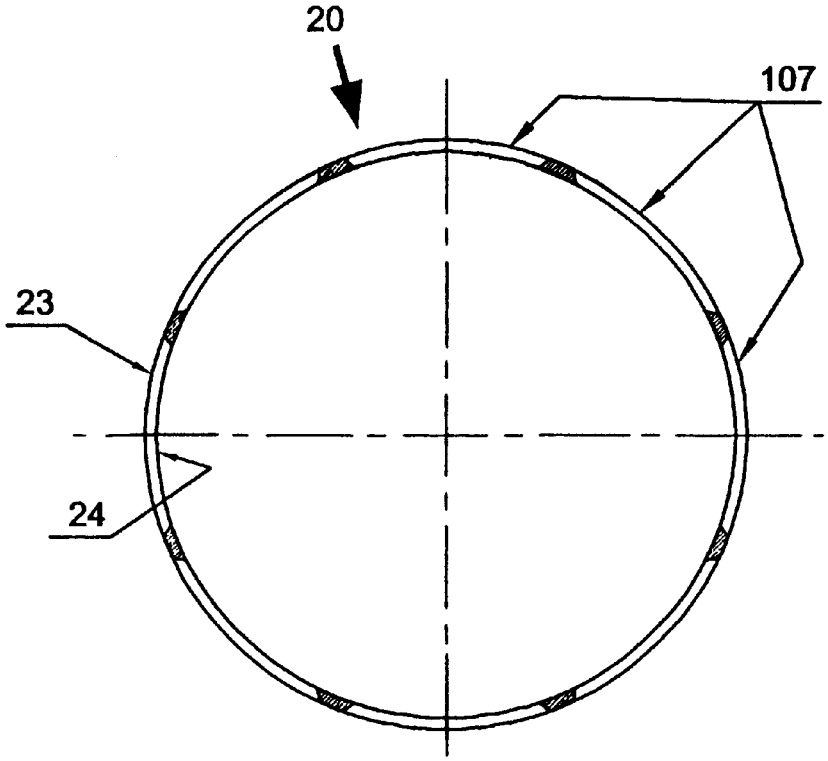
FIG. 2*a* is a perpendicular cross-section view of the outer cylinder taken along lines 2*a*—2*a* of FIG. 2.

FIG. 2 is longitudinal cross-section view of outer cylinder 20. Though it is not necessary, the preferred embodiment of the outer cylinder 20 is a pipe which is circular in profile. FIG. 2*a* is a perpendicular cross-section view of the outer cylinder 20 taken along lines 2*a*—2*a* of FIG. 2. In FIGS. 2 and 2*a*, the outer cylinder, or pipe, 20 has an outer plurality of water passage apertures 107, preferably in the form of slots, that extend from the outer surface 23 to the inner surface 24 of the outer pipe 20. In FIG. 2, the slots 107 are grouped into outer groupings 25. Thus, a pattern of outer groupings 25 are formed on the outer pipe 20 to allow maximum water throughput while retaining integral strength for handling. The outer pipe also has an outer pipe length "O", a first or upper end 21, and a second or lower end 22.

Figure 3A:
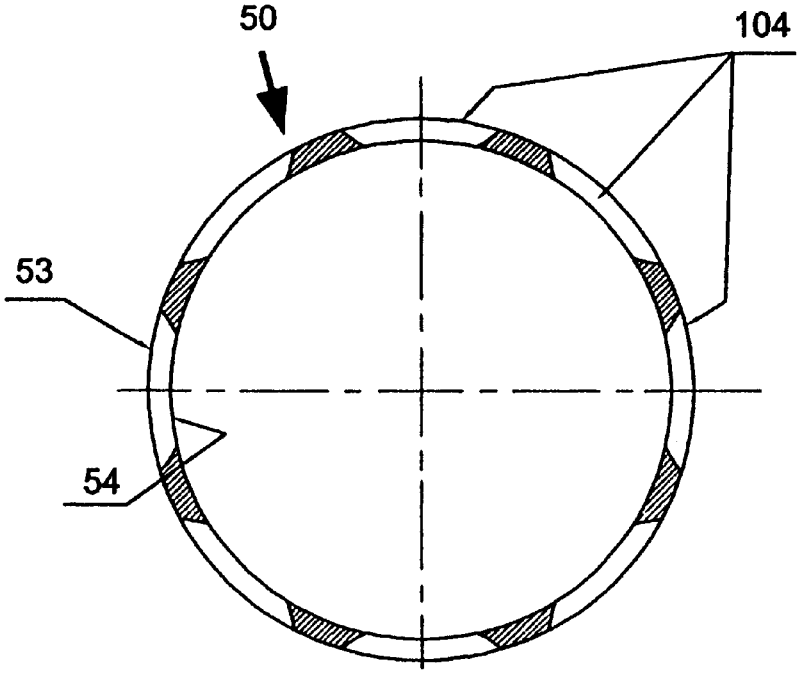
FIG. 3*a* is a perpendicular cross-section view of the inner cylinder taken along lines 3*a*—3*a* of FIG. 3.
Figure 3:
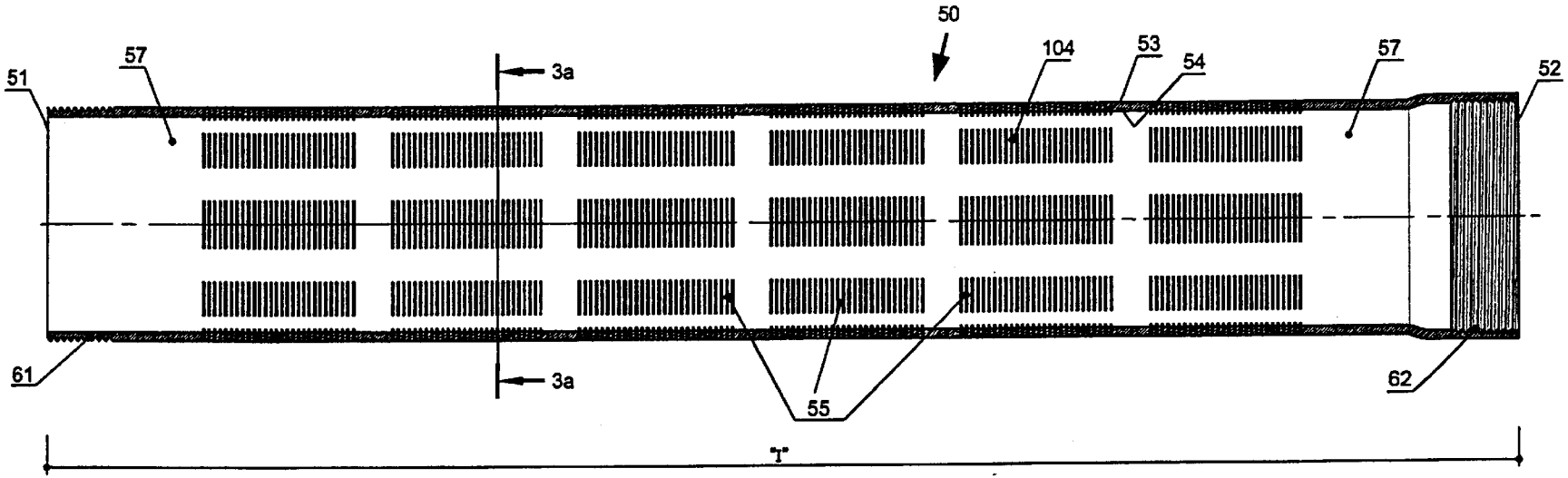
FIG. 3 is a longitudinal cross-section view of the inner cylinder or pipe 50.

FIG. 3 is longitudinal cross-section view of the inner cylinder 50. Similar to the outer cylinder 20, the inner cylinder 50 need not be, but preferably is, a pipe which is circular in profile. FIG. 3*a* is a perpendicular cross-section view of the inner cylinder 50 taken along lines 3*a*—3*a* of FIG. 3. In FIGS. 3 and 3*a*, the inner pipe 50 has an inner plurality of water passage apertures 104, also preferably in the form of slots, that extend from the outer surface 53 to the inner surface 54 of the inner pipe 50. In FIG. 3, the inner pipe slots 104 are grouped into inner groupings 55. Similar to the pattern of outer groupings 25, a pattern of inner groupings 55 are formed on the inner pipe 50 to allow maximum water throughput while retaining integral strength for handling. At a first or upper end 51 of the inner pipe 50, an externally threaded portion 61 is formed. At an opposite second or lower end 52, an internally threaded portion 62 is formed. However, the externally threaded portion 61 may be located at the second end 52, and the internally threaded portion 62 may be located at the first end 51 so long as the upper end 51 of the inner pipe 50 comprises means to attach to a lower end of another water well filter (not shown). The inner pipe 50 has an inner pipe length "I". Adjacent to the first and second ends 51, 52 are non-apertured portions 57.

In FIG. 1, the inner pipe length "I" is greater than the outer pipe length "O". The inner pipe slots 104 are formed and the outer pipe 20 is coupled to the inner pipe 50 such that the inner pipe slots 104 are all covered by the outer pipe 20. Thus, the length "O" of the outer pipe 20 is such that when the outer pipe 20 is coupled to the inner pipe 50, the outer pipe 20 covers all the inner pipe slots 104 and overlaps onto the solid, non-apertured portions 57 of the inner pipe 50. The outer pipe 20 is coupled to the inner pipe 50 by annular sealing rings 71 disposed at the upper and lower ends 21, 22 of the outer pipe 20. The sealing rings 71 are preferably made of the same UPVC material as that of the inner and outer pipes 20, 50. Therefore, the sealing rings 71 may be welded onto the inner and outer pipes 20, 50 to firmly fix the outer pipe 20 to the outer surface 53 of the inner pipe 50.

Figure 4:
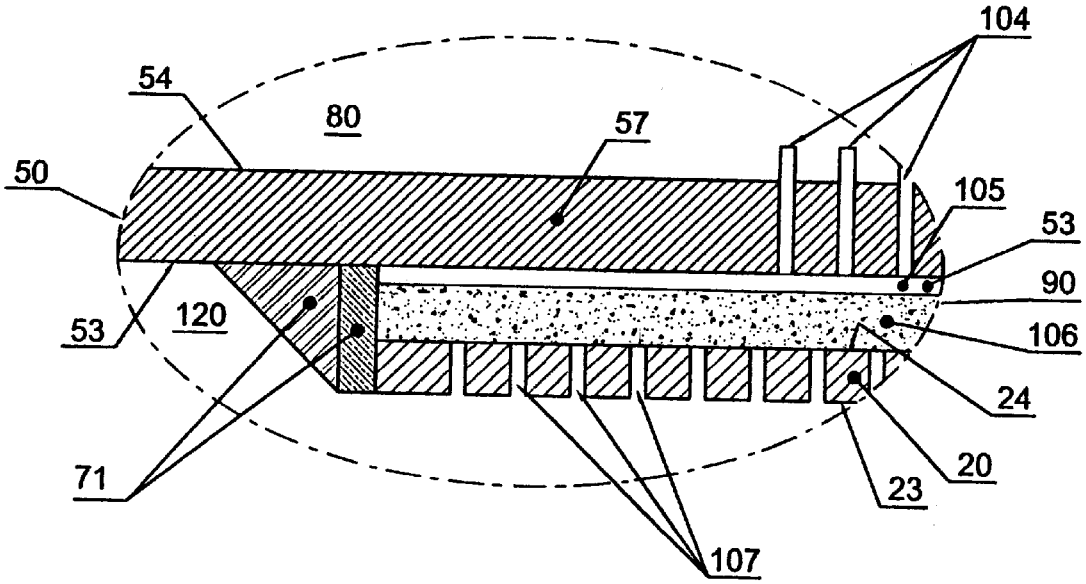
FIG. 4 is a close-up cross-sectional view of the encircled area 4' in FIG. 1.

FIG. 4 is a close-up cross-sectional view of the encircled area 4' in FIG. 1. The outer pipe 20 is coupled to the inner pipe 50 by the sealing rings 71 such that a gap 90 is defined between the outer surface 53 of the inner pipe 50 and the inner surface 24 of the outer pipe 20. In FIG. 1, the gap 90 has a first end 91 adjacent to the first end 21 of the outer pipe 20 and a second end 92 adjacent to the second end 22 of the outer pipe 20. In FIG. 4, a permeable, granulated filter material 106 fills the gap 90. Thus, the sealing rings 71 serve to close the gap 90 and seal in the granulated filter material 106 disposed in the gap 90. In the preferred embodiment, the granulated filter material 106 comprises granules of UPVC. The granulated filter material 106 may also comprise granules of sand, gravel, or other fine granulated material which when compacted together prevent the entry of foreign particles while allowing liquid to flow through.

In FIG. 4, a permeable cover 105 having openings (not shown) is disposed on the outer surface 53 of the inner pipe 50. The permeable cover 105 prevents filter granules 106 from entering the inner plurality of water passage apertures 104 which typically have an inner aperture cross-dimension greater than the cross-dimension of the filter granules 106. The permeable cover 105 preferably consists of nylon mesh. The openings (not shown) on the permeable cover 105 have a cross-dimension less than the cross-dimension of the granules 106 such that the granules 106 cannot pass through the nylon mesh cover 105 and enter through the inner pipe slots 104. The granulated filter material 106 may be densely packed.

The granulated filter material 106 may include a bonding mechanism (not shown) which bonds the filter granules 106 to each other. The bonding mechanism may also be used to bond the granules to: 1) first, the inner surface 24 of the outer pipe 20, and 2) second, the outer surface 53 of the inner pipe 50, or the permeable cover 105. The permeable cover 105 might not be necessary when the filter granules 106 are bonded because the bonded granules 106 will not escape through the inner plurality of water passage apertures 104.

In FIG. 1, the externally threaded portion 61 and the internally threaded portion 62 allow the water well filter 10 to be threadedly connected to additional water well filters, thus forming an elongated structure consisting of multiple water well filters. The elongation enables filtering of water at deep underground levels such as in the aquifer levels.

Figure 5:
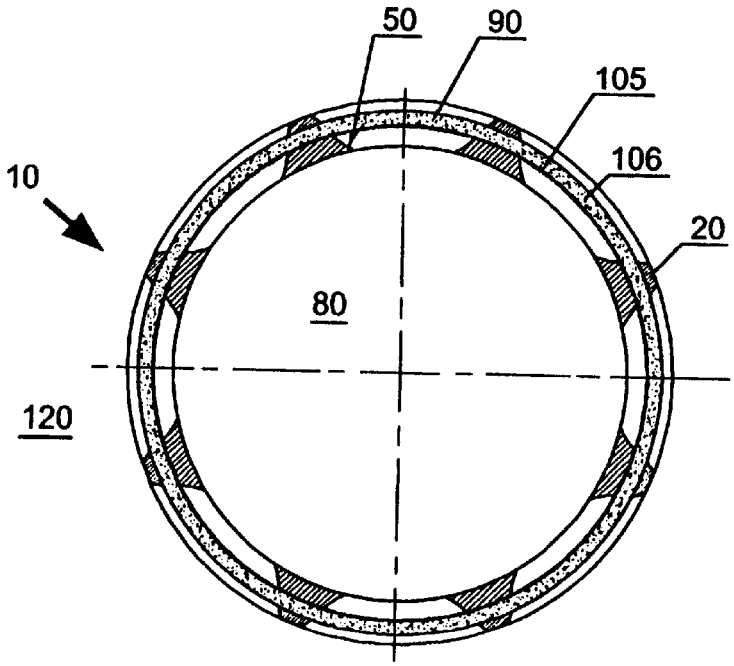
FIG. 5 is a perpendicular cross-section view of the water well filter 10 taken along lines 5—5 of FIG. 1.

FIG. 5 is a perpendicular cross-section view of the water well filter 10. From an exterior 120 to an interior 80 of the water well filter 10, FIG. 5 shows the outer pipe 20, the granulated filter material 106, the mesh covering 105, and the inner pipe 50. Where the inner and outer pipes 50, 20 are circular in profile and concentric, as shown in FIG. 5, the gap 90 and the sealing rings 71 (shown in FIG. 1) are, therefore, annular.

The structure of the water well filter 10 now having been described, turn now to its operation.

Figure 6:
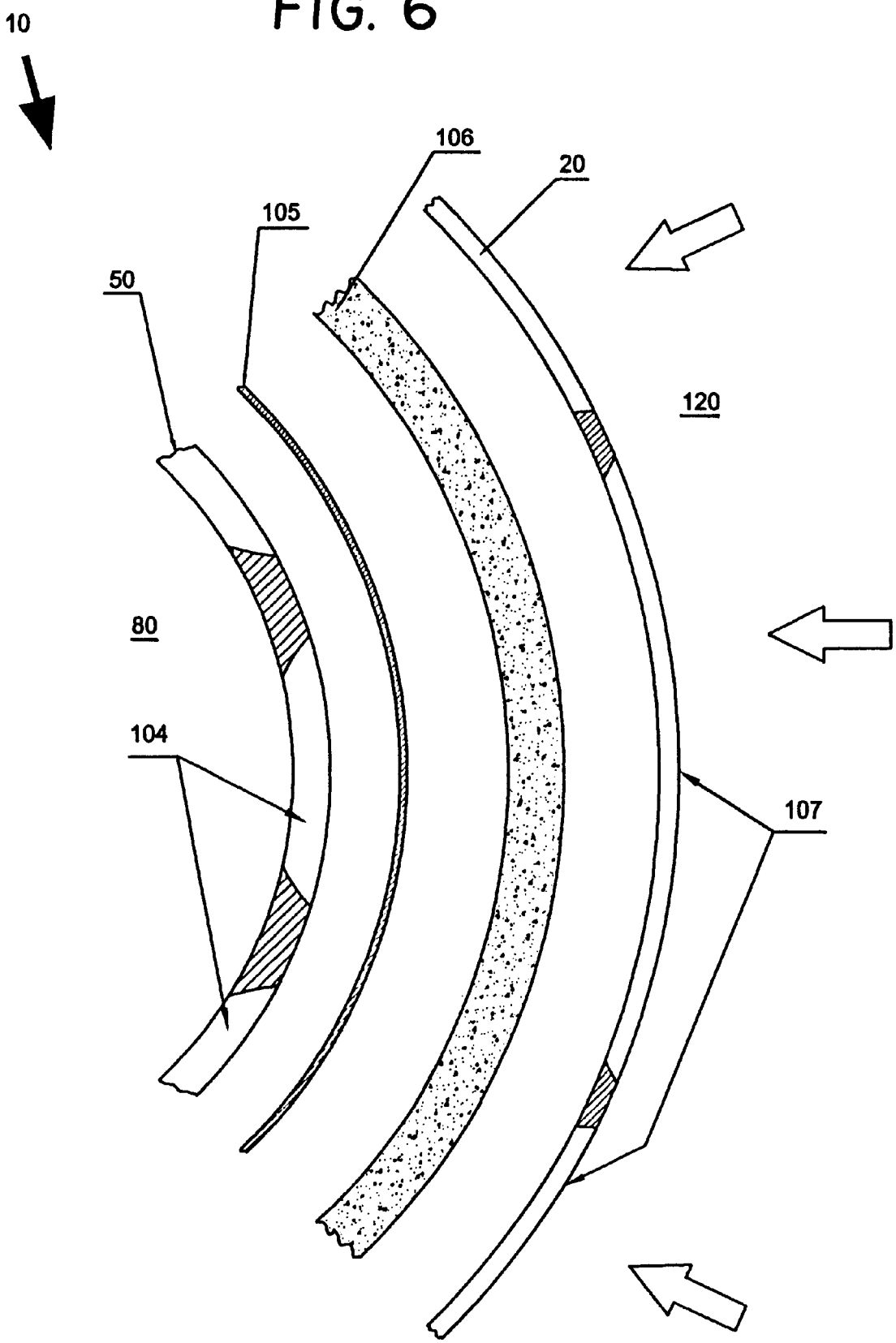
FIG. 6 is an exploded view of the perpendicular cross-section shown in FIG. 5.

FIG. 6 is an exploded view of the perpendicular cross-section shown in FIG. 5. Thus, in FIG. 6, water (depicted by arrows) containing particulate matter (not shown) will first encounter the outer pipe slots 107. The outer pipe slots 107 will prevent larger particles from entering through the outer pipe 20. As water containing smaller particles enters through the outer pipe 20, the granulated filter material 106 halts the progress of such smaller particles while allowing water to pass through. The nylon mesh covering 105 serves as an additional filter to block any particles which may have passed through the granulated filter material 106. The inner pipe slots 104 serve as a final filter to block any minute particles that may have passed through the nylon mesh covering 105. Unlike prior art filters which include only one pipe wall, and thus only one level of filtering, between the exterior and the interior of the filter, the water well filter 10 comprises four levels of filtering between the exterior 120 and the interior 80 of the water well filter 10:

1) outer pipe slots 107;
2) granulated filter material 106;
3) nylon mesh covering 105; and
4) inner pipe slots 104.

Therefore, it can be appreciated that the water well filter 10 provides more extensive and effective filtering, which leads to cleaner water than prior art filters. Since the outer pipe 20, inner pipe 50, sealing rings 71 and granulated filter material all comprise of UPVC, the various components will not mix or react chemically with each other. Also, since UPVC can be recycled, the use of UPVC leads to greater efficiency and less expense in the manufacturing of the water well filters 10. Furthermore, UPVC will not react or undergo detritus as a result of prolonged contact with water. Being low in density, UPVC is lighter in weight, and yet more durable, than metal, thus making the water well filter 10 easier to use and longer lasting.

Unlike prior art plastic filters which include only a single pipe, the dual pipe structure of the water well filter 10 makes the entire filter 10 stronger. The outer pipe 20 reinforces the strength of the inner pipe 50 while the inner pipe 50 reinforces the strength of the outer pipe 20. Therefore, as each pipe 20, 50 reinforces the other, the overall column strength of the water well filter 10 is increased, thereby allowing each pipe to contain more slots. Having more slots leads to higher water throughput. Therefore, the present invention 10 allows for greater water throughput than the prior art because the single pipe filter in the prior art could not contain more slots beyond a certain amount without weakening the column strength of the filter.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The claims are thus to be understood to include what is specifically illustrated and described above, what is conceptionally equivalent, what can be obviously substituted and also what essentially incorporates the essential idea of the invention.

I claim:

1. A water well filter comprising:

an inner cylinder having a first length, an upper end, a lower end, an inner surface, an outer surface, and an inner plurality of water passage apertures extending from the outer surface to the inner surface of the inner cylinder, the inner plurality of water passage apertures having an inner aperture cross-dimension;

an outer cylinder surrounding the inner cylinder, the outer cylinder having a second length, an upper end, a lower end, an inner surface, an outer surface, and an outer plurality of water passage apertures extending from the outer surface to the inner surface of the outer cylinder, the second length being such that the outer cylinder covers the inner plurality of water passage apertures;

a gap defined by the outer surface of the inner cylinder and the inner surface of the outer cylinder; and filter granules disposed in the gap, the filter granules having a granule cross-dimension less than the inner aperture cross-dimension; and a permeable cover disposed on the outer surface of the inner cylinder over the inner plurality of water passage apertures, the permeable cover having openings with an opening cross-dimension less than the granule cross-dimension such that the filter granules cannot reach the inner plurality of water passage apertures and enter the inner cylinder.

2. The water well filter of claim 1 wherein the inner cylinder and the outer cylinder are circular in profile, the outer cylinder being concentric with the inner cylinder such that the gap is annular.

3. The water well filter of claim 1 wherein the inner plurality of water passage apertures and the outer plurality of water passage apertures comprise slots.

4. The water well filter of claim 1 wherein the inner cylinder comprises a first polymer material.

5. The water well filter of claim 4 wherein the first polymer material comprises unplasticized polyvinyl chloride.

6. The water well filter of claim 1 wherein the outer cylinder comprises a second polymer material.

7. The water well filter of claim 6 wherein the second polymer material comprises unplasticized polyvinyl chloride.

8. The water well filter of claim 1 wherein the first length of the inner cylinder is greater than the second length of the outer cylinder.

9. The water well filter of claim 1 wherein the upper end of the inner cylinder comprises a means to attach to a lower end of another inner cylinder of another water well filter.

10. The water well filter of claim 1 further comprising a lower and upper ring, the lower ring sealing a lower end of the gap, the upper ring sealing an upper end of the gap.

11. The water well filter of claim 10 wherein the lower and upper ring connect the outer cylinder to a non-apertured portion of the outer surface of the inner cylinder.

12. The water well filter of claim 11 wherein the lower ring is welded onto the inner and outer cylinder, wherein the upper ring is welded onto the inner and outer cylinder.

13. The water well filter of claim 1 wherein the filter granules comprise unplasticized polyvinyl chloride.

14. The water well filter of claim 13 wherein the filter granules are bonded together.

15. The water well filter of claim 14 wherein the filter granules are bonded to the outer surface of the inner cylinder and the inner surface of the outer cylinder.

16. The water well filter of claim 1 wherein the permeable cover comprises a nylon mesh.

17. A water well filter comprising:

an inner pipe having an inner surface, an outer surface, a plurality of inner pipe slots, an inner pipe length, an upper end, and a lower end, the inner pipe comprising a polymer material, the inner pipe slots having a first cross-dimension;

a permeable cover disposed on the outer surface of the inner pipe over the plurality of inner pipe slots, the permeable cover having openings with an opening cross-dimension;

an outer pipe having an inner surface, an outer surface, a plurality of outer pipe slots, an outer pipe length less than the inner pipe length, an upper end, a lower end, the outer pipe comprising the polymer material, the outer pipe length being such that the outer pipe covers the plurality of inner pipe slots;

a lower and upper seal connecting the outer pipe to the inner pipe to form a gap between the outer surface of the inner pipe and the inner surface of the outer pipe, the lower seal closing a lower end of the gap, the upper seal closing an upper end of the gap; and filter granules filling the gap, the filter granules having a granule cross-dimension that is less than the first cross-dimension but greater than the opening cross-dimension such that the filter granules cannot reach the plurality of inner pipe slots and enter the inner pipe.

18. The water well filter of claim 17 wherein the filter granules comprises unplasticized polyvinyl chloride.

19. The water well filter of claim 18 wherein the filter granules are bonded together.

20. The water well filter of claim 19 wherein the filter granules are bonded to the outer surface of the inner pipe and the inner surface of the outer pipe.

21. The water well filter of claim 17 wherein the permeable cover comprises a nylon mesh.

22. The water well filter of claim 17 wherein the polymer material of the inner and outer pipe comprises unplasticized polyvinyl chloride.

23. The water well filter of claim 17 wherein the upper and lower seal comprise unplasticized polyvinyl chloride.

24. The water well filter of claim 17 wherein the upper seal is welded to the inner pipe and the outer pipe, wherein the lower seal is welded to the inner pipe and the outer pipe.

25. The water well filter of claim 17 wherein the inner pipe further comprises an internally threaded portion at one of the upper or lower ends of the inner pipe, and an externally threaded portion at an opposite end of the inner pipe.

26. A method for filtering out particulate matter from water in a well, the method comprising:

passing the water through a first plurality of apertures in a first barrier;

blocking an initial portion of the particulate matter with the first barrier;

passing the water through filter granules having a granule cross-dimension;

blocking a first intermediate portion of the particulate matter with filter granules;

providing a second barrier having a second plurality of apertures with an aperture cross-dimension that is greater than the granule cross-dimension;

disposing onto the second barrier a permeable cover having a plurality of openings with an opening cross-dimension that is less than the granule cross-dimension;

passing the water through the plurality of openings in the permeable cover;

blocking a second intermediate portion of the particulate matter with the permeable cover;

blocking the filter granules from entering the second plurality of apertures in the second barrier with the permeable cover;

passing the water through the second plurality of apertures in the second barrier; and blocking a final portion of the particulate matter with the second barrier.

* * * * *